US007651046B2

(12) United States Patent
Schmalholz

(10) Patent No.: US 7,651,046 B2
(45) Date of Patent: Jan. 26, 2010

(54) BOBBIN WINDING DEVICE

(75) Inventor: Peter Schmalholz, Voesendorf (AT)

(73) Assignee: Starlinger & Co Gesellschaft m.b.H., Vienna (AT)

( * ) Notice: Subject to any disclaimer, the term of this patent is extended or adjusted under 35 U.S.C. 154(b) by 285 days.

(21) Appl. No.: 10/568,906

(22) PCT Filed: Aug. 12, 2004

(86) PCT No.: PCT/AT2004/000287

§ 371 (c)(1),
(2), (4) Date: Jul. 19, 2006

(87) PCT Pub. No.: WO2005/019081

PCT Pub. Date: Mar. 3, 2005

(65) Prior Publication Data

US 2006/0261206 A1 Nov. 23, 2006

(30) Foreign Application Priority Data

Aug. 20, 2003 (AT) ..... A 1313/2003

(51) Int. Cl.
*B65H 54/28* (2006.01)

(52) U.S. Cl. ..... 242/477; 242/157 R

(58) Field of Classification Search ..... 242/157 R, 242/157.1, 413.3, 413.4, 413.5, 476.7, 476.9, 242/477, 484.6, 485.9, 486, 486.1, 486.3, 242/486.4, 486.7, 486.8, 615.1
See application file for complete search history.

(56) References Cited

U.S. PATENT DOCUMENTS 2,623,701 A 12/1952 Nuttle
3,276,705 A * 10/1966 Erickson et al. ..... 242/419.9
4,169,564 A 10/1979 Lehmann et al.
4,685,629 A * 8/1987 Sugioka ..... 242/474.5
6,349,896 B1 2/2002 Adcock et al.

FOREIGN PATENT DOCUMENTS

| | | |
|---|---|---|
| DE | 953632 | 12/1956 |
| GB | 865905 | 4/1961 |
| GB | 978328 | 12/1964 |
| JP | 60135734 | 7/1985 |

* cited by examiner

*Primary Examiner*—John Q Nguyen
*Assistant Examiner*—William E Dondero
(74) *Attorney, Agent, or Firm*—Townsend and Townsend and Crew, LLP

(57) ABSTRACT

A bobbin winding device for generating a bobbin by winding a thread or bandlet onto a bobbin core comprises fixing means (12) for holding a bobbin core (8) and rotating it around an axis of rotation (A), thread-pressing means (7) for pressing a thread (1) or bandlet against the peripheral surface of a bobbin (9) that builds up on the bobbin core (8), whereby the thread-pressing means are movable essentially radially relative to the axis of rotation (A), a traversing thread guide (10) located close to the thread-pressing means (7) for reciprocating the thread (1) or bandlet along the axis of rotation (A), and thread-support means (14) for conducting the thread supplied to the bobbin or bobbin core, respectively, in an axially stationary manner relative to the axis of rotation (A). The thread-pressing means (7) are movable essentially radially relative to the axis of rotation (A) together with the thread-support means (14) so that the distance (z) between the thread-pressing means (7) and the thread-support means (14) will remain constant.

18 Claims, 7 Drawing Sheets

BOBBIN WINDING DEVICE

BACKGROUND OF THE INVENTION

The invention relates to a bobbin winding device for generating a bobbin by winding a thread or bandlet onto a bobbin core.

Bobbin winding devices serve for winding threads or bandlets onto a bobbin core, which usually has a cylindrical or conical shape, so as to form a bobbin. In case of a known bobbin winding device as illustrated in side view in the schematic diagram of FIG. 1, a thread 1 gets to a first deflection pulley 2 of the bobbin winding device immediately upon its production. From there, the thread 1 runs on to a so-called "dancer roll" 3, which is a spring-biased, deflectable deflection pulley, and at the dancer roll it is deflected and tightened. From the dancer roll 3, the thread 1 runs on to another deflection pulley 4, and from there to a control device 5. The control device comprises thread deflection means 6, which may be configured as deflection bows, as well as a press roll 7, which at first, at the beginning of a bobbin winding process, presses the thread 1 against the peripheral surface of a bobbin core 8 and then, with a bobbin 9 building up from the supplied thread, against the periphery of the bobbin 9 that is building up. The bobbin core 8 is rotatable around an axis of rotation A. A thread guide 10 reciprocating the thread axially across the bobbin, thus providing for a regular bobbin structure in accordance with a predetermined winding pattern, is located on the control device 5 between the deflection means 6 and the press roll 7. So as to maintain a uniform pressure force of the press roll 7 against the bobbin 9 as the bobbin diameter D is increasing, the control device 5 is pivotable about a swivel axis C and is thus able to compensate for the increasing bobbin diameter. The arrow ρ(D) represents the deflection angle of the control device 5 depending on the bobbin diameter D.

The bobbin 9 or the bobbin core 8 is driven by a motor (not illustrated) at an angular velocity Ω. The tension in the thread 1 as it is being wound onto the bobbin 9 is critical for the quality of the bobbin winding. If the tension in the thread slackens, the motor speed must be increased in order to restore the desired tension. The dancer roll 3 serves for regulating the motor speed, which dancer roll already by itself provides for a certain compensation of the thread tension due to its spring bias. An increase in the motor speed is caused if the dancer roll 3 sags because of decreasing tension in the thread 1. If the dancer roll 3 rises because of an increase in the thread tension, the motor speed is reduced. Variations in the thread tension which necessitate changes in the motor speed will occur if the bobbin diameter D increases or if the thread production, and hence the supply of the thread to the bobbin winding device, accelerates or decelerates.

Another reason for variations in the thread tension is the axial movement of the thread guide 10, such as explained by way of the perspective illustration of FIG. 2. FIG. 2 shows the path of the thread 1 from the deflection pulley 4, via a deflection means 6 shaped like a straight deflection bow, through the thread guide 10 and, via the press roll 7, onto the bobbin 9. If the thread guide 10 is at the axial ends of the bobbin 9 during its axial reciprocation, the thread 1 is guided to the bobbin edge, thereby defining a path from the deflection pulley 4 to the bobbin edge which is longer than with the thread guide 10 situated at the center of the bobbin and with the thread 1 defining the path from the deflection pulley 4 to the bobbin center (illustrated by a broken line). Due to the shortened thread path, the thread becomes loose at the center of the bobbin. As the axial movement of the thread is generally performed at a relatively high frequency, the resulting thread-tension variation cannot be compensated for by regulating the rotational speed of the bobbin drive motor, since any kind of control unit, such as a PID controller, would either be too slow or would, under such conditions, be prone to unstable oscillation, i.e. an unstable control behavior. Therefore, so far it has been possible to contain the influence of the thread paths which have different lengths at the bobbin edge and at the bobbin center, respectively, on the thread tension merely by means of an as large as possible distance between the deflection pulley 4 and the press roll 7. If the distance is larger, the angle extending between the deflection pulley 4 and the two positions of the thread 1 at the bobbin edges and hence also the factor (cosine) of longitudinal deformation will become smaller.

Again with reference to the illustration of FIG. 1, it is evident that the thread-path length x(ρ) between the stationary deflection pulley 4 and the deflection means 6 attached to the control device 5 changes depending on the bobbin diameter D, since an increase in the bobbin diameter will result in a deflection of the control device 5 in the direction of the deflection pulley 4. With a deflection of the control device 5, the distance z(ρ) between the press roll 7 located on the control device 5 and the stationary deflection pulley 4 will change as well. The distance y between the press roll 7 and the deflection means 6 remains constant irrespective of the deflection of the control device 5.

The effects of incorrect thread tensions on the quality of the bobbin are enormous. The choice of thread tension for the winding process will not be discussed in full detail now, however, in general terms it can be said that an incorrect thread tension and in particular a varying tension of the thread between the bobbin edge and the bobbin center will result in a thread that falls off the edge of the bobbin, such as illustrated in FIG. 3. In FIG. 3 it can be seen that the thread 1 has fallen off the edge of the bobbin 9 and onto the bobbin core 8 and would subsequently wind itself around the bobbin core. This falling off of the thread might have an impact on the production capacity already during the process of manufacturing the bobbin and could lead to dead halts, or might have an impact when using the bobbin later on, for example when weaving the thread, and could then lead to dead halts or breakdowns.

The fact that the thread does not fall off is thus one of the most important features of a bobbin. With the known bobbin winding devices it was, however, difficult to fulfill that criterion in a satisfactory manner. Particularly as a result of the high winding frequency, it was not possible to compensate for the varying thread tensions between the bobbin edge and the bobbin center by the use of motor control systems.

SUMMARY OF THE INVENTION

It therefore is an object of the invention to provide a bobbin winding device which avoids the above-indicated disadvantages and by means of which it is possible to wind bobbins of a significantly increased quality.

The bobbin winding device according to the invention for generating a bobbin by winding a thread or bandlet onto a bobbin core comprises fixing means for holding a bobbin core and rotating it around an axis of rotation, thread-pressing means for pressing a thread or bandlet against the peripheral surface of a bobbin that builds up on the bobbin core, whereby the thread-pressing means are movable essentially radially relative to the axis of rotation, with the thread-pressing means preferably being configured as a press roll with a longitudinal axis oriented in parallel to the axis of rotation, a traversing thread guide located close to the thread-pressing means for reciprocating the thread or bandlet along the axis of rotation, and thread-support means for conducting the thread supplied to the bobbin in an axially stationary manner relative to the axis of rotation. The solution according to the invention consists in that the thread-pressing means are movable essentially radially relative to the axis of rotation together with the thread-support means so that the distance between the thread-pressing means and the thread-support means will remain constant. By this measure, the impact of the bobbin diameter which increases during winding on the thread tension is eliminated.

It should be mentioned that in the following description the term "thread" is mostly used. However, in this context, the term is understood to cover bandlets as well. As an exemplary embodiment of a bandlet, a stretched single or multi-layer plastic bandlet is mentioned.

Furthermore, it must be mentioned that the bobbin core is usually an element made of cardboard, a synthetic material or metal, which is attached to a rotatable fixing device and forms a carrier for the thread to be wound. However, in some applications, the fixing device can be configured as a spindle onto which the thread is wound directly and from which spindle the bobbin is withdrawn upon its completion. In such applications, the term bobbin core as used herein refers to the spindle.

Although it is conceivable to arrange the traversing thread guide between the thread-pressing means and the thread-support means without any further thread support, for reasons of a smoother thread supply to the bobbin it is preferable if at least one thread deflection means is arranged between the thread-pressing means and the thread-support means, which thread deflection means is movable radially relative to the axis of rotation together with the thread-pressing means and the thread-support means. The thread deflection means can thereby be configured as a thread-path compensating means which compensates for the different lengths of the thread path from the thread-support means to the thread-pressing means between the bobbin edge and the bobbin center, such as illustrated below in further detail. In a very robust and reliable embodiment, the thread-path compensating means is configured as a deflection bow which is curved at a predetermined radius. According to the state of the art, the configuration of the thread-path compensating means as a circular-arc-shaped deflection bow could be optimized only for a particular bobbin diameter, wherein the radius of the deflection bow was adjusted to the distance between the thread-support means and the deflection bow, whereas thread paths of different lengths continued to be provided at the bobbin edge and at the bobbin center if the particular bobbin diameter was exceeded or fallen short of. According to the invention, the distance between the thread-support means and the deflection bow remains unchanged independently of the respective diameter so that it will be possible to achieve a perfect thread-path compensation between the bobbin edge and the bobbin center for all bobbin diameters by means of a circular-arc-shaped deflection bow whose radius is adjusted to the sum of thread paths from the thread-support means to the deflection bow, and further on to the thread-pressing means.

In a preferred embodiment of the bobbin winding device according to the invention, the thread-pressing means, the thread-support means and optionally also the thread deflection means are pivotable about a common swivel axis running in parallel to the axis of rotation of the bobbin. In a mechanically very stable and compact embodiment, the thread-pressing means, the thread-support means and optionally the thread deflection means are integrated in a control device which is pivotable about the above-mentioned swivel axis.

Great constructional reliability of the bobbin winding device is achieved if the thread-support means are configured as a roll or lug. In a very robust embodiment of the invention, the thread deflection means is configured as a deflection bow.

In a preferred embodiment of the bobbin winding device according to the invention, a thread-tension sensor is arranged upstream of the thread-support means. However, unlike the prior art devices, the thread-tension sensor is not subject to any quick variations in the thread tension caused by different bobbin diameters so that its output signal can be used with great reliability for regulating the thread tension.

In a first mechanically simple embodiment, the thread-tension sensor is arranged in a stationary manner. In that embodiment, the deflection angle of the thread on the thread-tension sensor would change for design reasons, which can be traced back to the positional change of the thread-support means in case of an increasing bobbin diameter. In this way, the measuring results of the thread-tension sensor could be slightly falsified. In order to remedy this possible disadvantage, a stationary thread deflection means can be arranged between the thread-support means and the thread-tension sensor in one embodiment of the invention.

In an alternative embodiment, the thread-tension sensor is arranged in a movable manner together with the thread-support means so that the distance therebetween will remain constant. In this embodiment, the above-mentioned problem of a varying thread deflection angle does not occur in the thread-tension sensor.

In a preferred embodiment of the invention, the thread-tension sensor comprises an arm with a strain gauge, with the arm carrying a thread deflection means which preferably produces a deflection of the thread or bandlet by 150 to 180°.

By the measures according to the invention for preventing varying thread-path lengths during the winding of the thread onto the bobbin and for preventing high-frequency thread-tension variations as a result thereof, it has become possible to use the output signals of the thread-tension sensor for controlling the bobbin motor. For that purpose, the output signals of the thread-tension sensor, which are representative for the thread tension, are supplied to a control unit, preferably a PID controller, as input signals, which control unit regulates the rotational speed of the bobbin drive motor depending on the input signals and a reference signal. By means of the electronic control, the quality of the bobbins can be substantially improved. Preferably, the drive motor rotates the fixing device of the bobbin core or the thread-pressing means.

BRIEF DESCRIPTION OF THE DRAWINGS

The invention will now be illustrated in further detail by way of non-limiting embodiments with reference to the drawings. In the drawings.

DESCRIPTION OF THE PREFERRED EMBODIMENTS

Figure 1:
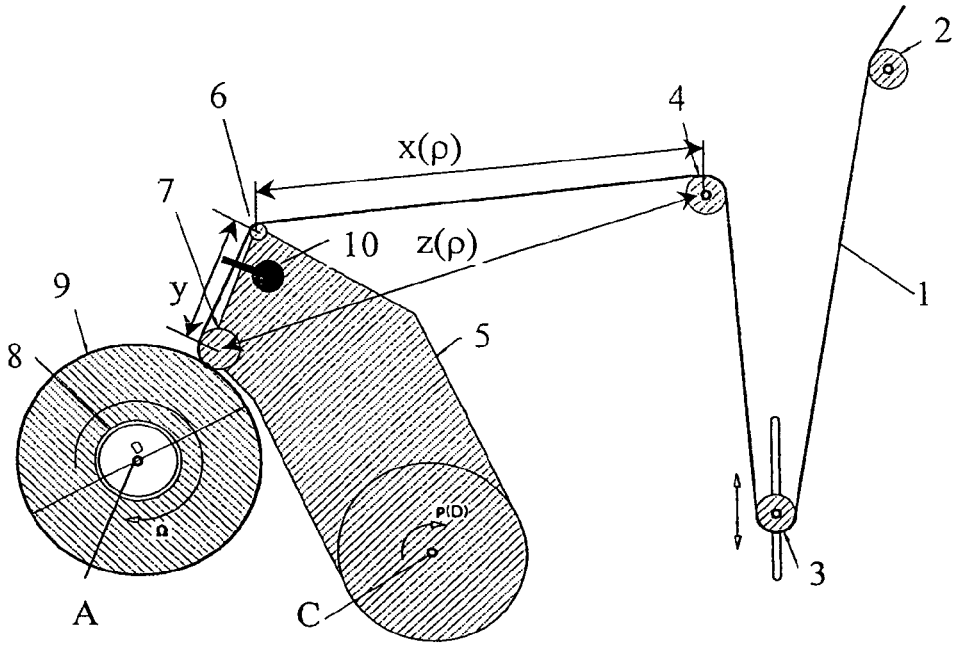
Fig. 1 (prior art)
FIG. 1 shows a schematic diagram of a known bobbin winding device.
Figure 4A:
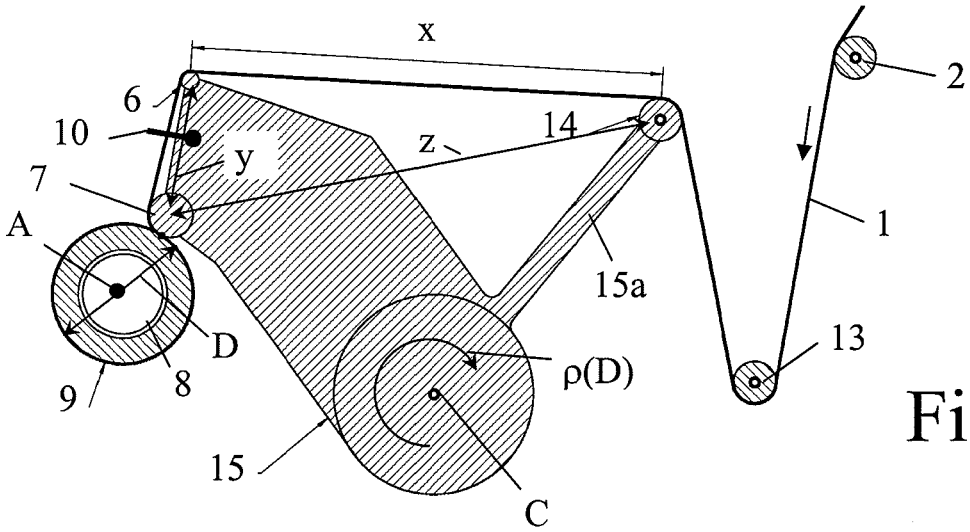
FIGS. 4A and 4B show schematically a first embodiment of the bobbin winding device according to the invention at different bobbin diameters.

In FIG. 4A, a first embodiment of the bobbin winding device according to the invention is schematically illustrated, which is an advancement of the known bobbin winding device according to FIG. 1. A thread 1 or bandlet gets to a first deflection pulley 2 of the bobbin winding device immediately upon its production. From there, the thread 1 runs on to a thread-tension sensor 13 equipped with a deflection pulley. An embodiment of the thread-tension sensor 13 will be described below in detail. From the thread-tension sensor 13, the thread 1 runs on to a thread-support means 14, which may be configured as a deflection pulley rotatably mounted to an arm 15*a* of a control device 15. The control device 15 furthermore comprises thread deflection means 6, which—such as in this exemplary embodiment—may be configured as straight deflection bows, as well as a press roll 7, which at first, at the beginning of a bobbin winding process, presses the thread 1 against the peripheral surface of a bobbin core 8 and then, with a bobbin 9 building up from the supplied thread, against the periphery of the bobbin 9 that is building up. The bobbin core 8 is rotatable around the axis of rotation A. A traversing thread guide 10 reciprocating the thread axially across the bobbin, thus providing for a regular bobbin structure in accordance with a predetermined winding pattern, is located on the control device 15 between the deflection means 6 and the press roll 7. So as to maintain a uniform pressure force of the press roll 7 against the bobbin 9 as the bobbin diameter D is increasing, the control device 5 is pivotable about a swivel axis C and is thus able to compensate for the increasing bobbin diameter. The arrow ρ(D) represents the deflection angle of the control device 5 depending on the bobbin diameter D.

Figure 4B:
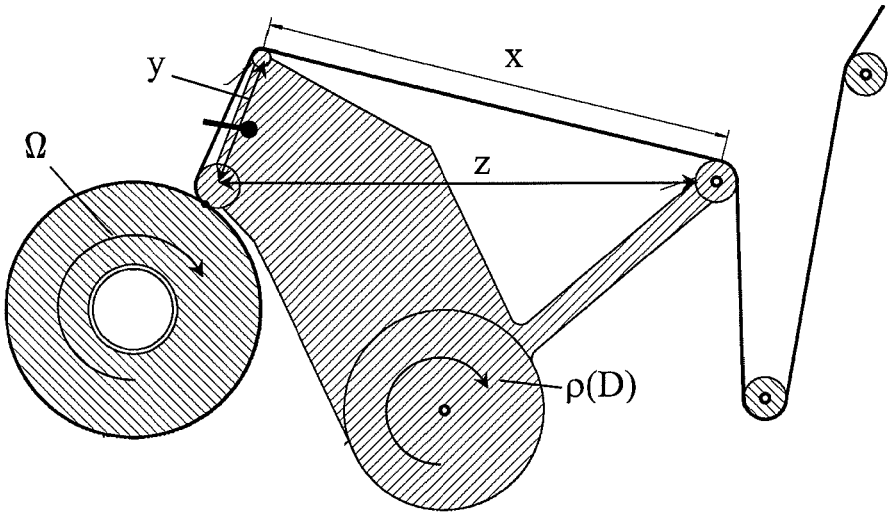

By means of the measure according to the invention of integrating the thread-support means 14 via the arm 15*a* in the control device 15, the distance x between the thread-support means 14 and the deflection means 6 as well as the distance z between the thread-support means 14 and the thread-pressing means 7 will remain constant independently of the instantaneous diameter D of the bobbin 9 and independently of the instantaneous deflection angle ρ(D) of the control device 15, as opposed to the prior art bobbin winding device. This is best visible when comparing FIG. 4A, wherein the bobbin 9 still has a small diameter D, with FIG. 4B, with FIG. 4B showing the bobbin winding device according to the invention of FIG. 4A at a later stage of the bobbin winding process, wherein the bobbin diameter has already substantially increased and hence the control device has pivoted by a larger angle ρ(D). However, as can be seen, the triangle extending between the thread-support means 14, the deflection means 6 and the thread-pressing means 7 remains constant with its sides x-y-z, independently of the deflection angle of the control device. Thus, the impact of the varying bobbin diameter on the thread tension was successfully eliminated.

Figure 2:
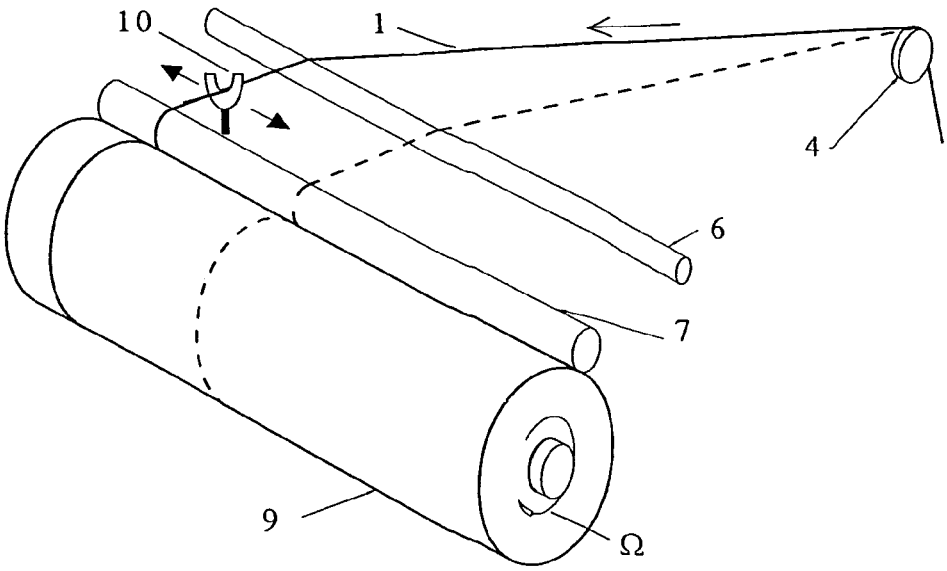
Fig. 2 (prior art)
FIG. 2 shows a thread deflection and pressing mechanism of the known bobbin winding device.
Figure 3:
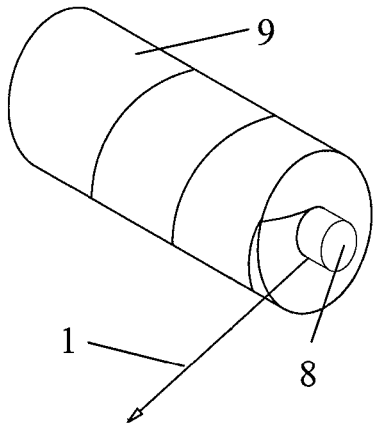
Fig. 3 (prior art)
FIG. 3 shows the effects of an incorrect thread tension during the manufacture of a bobbin.

However, the embodiment of the bobbin winding device according to the invention as in accordance with FIGS. 4A and 4B comprising a thread deflection means 6 configured as a straight deflection bow still exhibits the dependency of the thread-path length on the position of the thread at the bobbin center or at the bobbin edge, such as described above with reference to FIG. 2. In order to minimize this influence, a large distance x between the thread-support means 14 and the thread deflection means 6 and a large distance z, respectively, between the thread-support means 14 and the thread-pressing means 7 are necessary.

Figure 5:
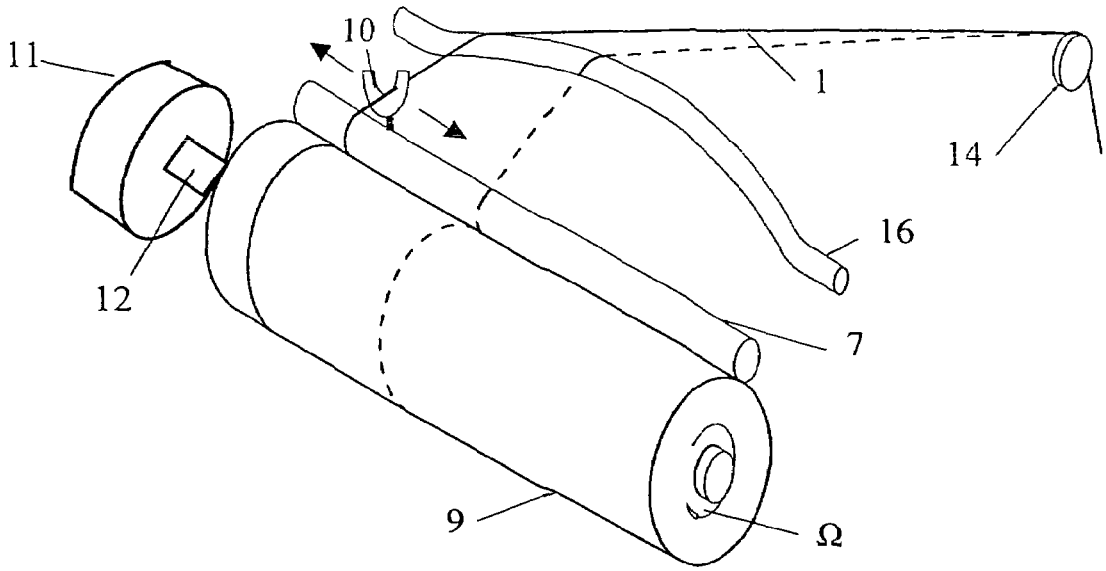
FIG. 5 shows a thread-path compensating means as part of a bobbin winding device according to the invention.
Figure 6:
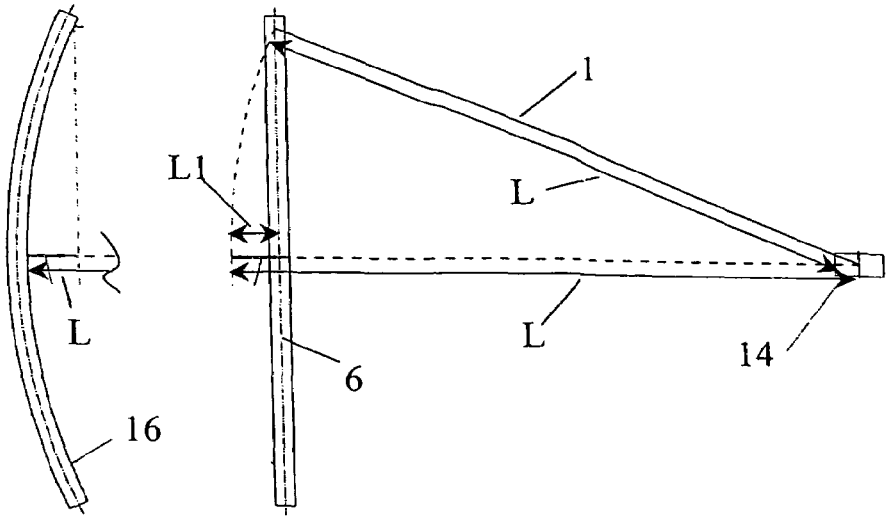
FIG. 6 shows the effectiveness of the thread-path compensating means of FIG. 5 in comparison with a straight deflection bow.

One possibility of completely compensating for the different thread-path lengths at the bobbin edge and at the bobbin center is shown in a perspective view in FIG. 5 and is based upon the configuration of the thread deflection means as a thread-path compensating means shaped like a curved deflection bow 16, with the radius of curvature of the deflection bow corresponding to the length L of the thread 1 between the thread-support means 14 and the deflection bow 16. If a curved deflection bow was integrated in the embodiment of FIGS. 4A and 4B instead of the straight deflection bow 6, the sum of distances x and y would, at each deflection point of the thread, be constant relative to the bobbin axis, whereas the distance y would decrease toward the bobbin edges. The effectiveness of such a thread-length compensation is illustrated in FIG. 6 by way of a comparison between a straight deflection bow 6 and a curved deflection bow 16. It can be seen that, in case of the straight deflection bow 6, the thread path projects at the bobbin center beyond the deflection bow by a distance L1. This leads to a slackening of the thread tension each time the thread is located at the center of the bobbin. Although the configuration of the thread deflection means as a curved deflection bow 16 is known per se, the measure obtains its full effectiveness only by means of the present invention, wherein the distance between the thread-support means 14 and the deflection bow 16 remains constant independently of the bobbin diameter. According to the state of the art it was only possible to optimize the radius of curvature of the deflection bow for a single bobbin diameter so that, with every bobbin diameter that deviated therefrom, differences in thread-path lengths would continue to exist between the bobbin edge and the bobbin center.

Again with reference to the illustration of FIG. 5, a motor 11 is schematically illustrated in the figure, which motor drives a bobbin-core fixing device 12 shaped like a spindle, thereby rotating the bobbin 9 at an angular velocity Ω.

Figure 7:
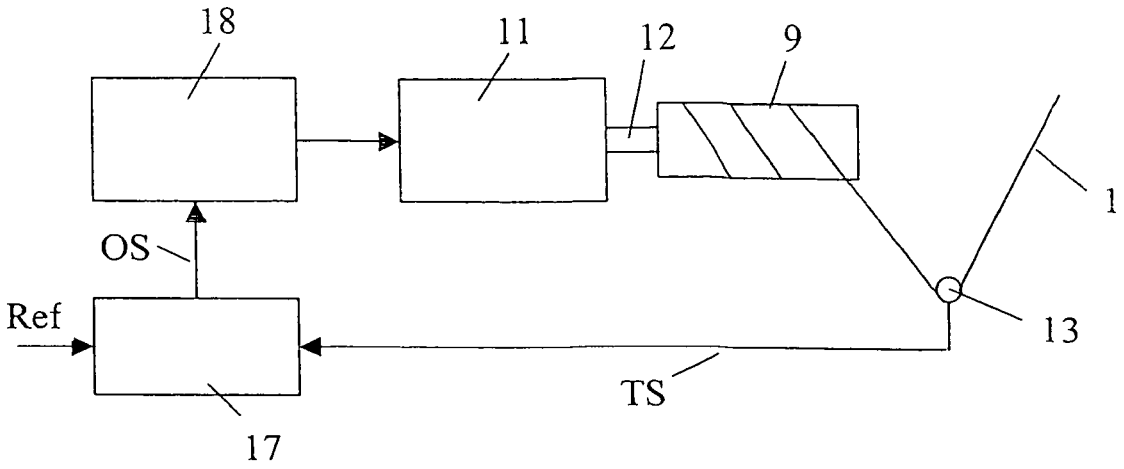
FIG. 7 shows a block diagram of an electronic motor control of the bobbin winding device according to the invention.

Such as initially mentioned, the tension in the thread 1 as it is being wound onto the bobbin 9 is critical for the quality of the bobbin winding. If the tension in the thread slackens, the motor speed must be increased in order to restore the desired tension; if the tension increases, the motor speed must be reduced. Since by means of the invention high-frequency variations in the thread tension are largely or completely eliminated when reciprocating the traversing thread guide 10, it thus becomes possible for the first time to use an electronic control circuit for regulating the motor speed, without the control circuit being prone to oscillations. By means of the electronic control it is possible to adjust the desired thread tension much more exactly than according to the state of the art where this was realized mechanically via a spring bias on a dancer roll. The electronic control loop is illustrated schematically in the block diagram of FIG. 7. Thereby, the motor 11 rotates the bobbin 9 via the bobbin-core fixing device 12, thus generating a particular thread tension in the thread 1 that is wound onto the bobbin 9, which thread tension is scanned by the thread-tension sensor 13 and is supplied to a control circuit 17 as an electrical signal TS. The control circuit 17 may advantageously be configured as a PI controller or as a PID controller. If the control circuit 17 detects that the instantaneous thread tension deviates from a set value Ref, it generates (or changes) an output signal OS acting on a motor driver 18 in order to adjust the rotational speed of the motor 11 such that the thread tension will be brought to the set value. Depending on the design of the motor 11, the motor driver 18 can, for instance, be configured as a static frequency converter.

Figure 8:
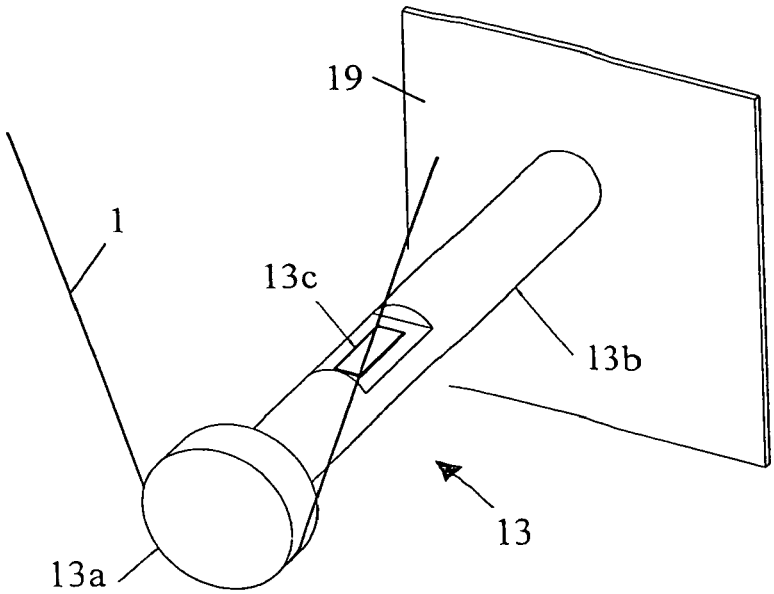
FIG. 8 is a perspective view of a thread-tension controller of the bobbin winding device according to the invention.

In FIG. 8, an embodiment of the thread-tension sensor 13 is illustrated in detail. The thread-tension sensor 13 comprises a deflection pulley 13*a* positioned at the free end of an extension arm 13*b*. The other end of the extension arm is securely fixed to a support 19. At about half length of the extension arm 13*b*, a strain gauge (DMS) 13*c* is fixed which continuously measures the tension of the thread 1 running around the roll 13*a*. More precisely, the strain gauge 13*c* measures the tension or upsetting deformation of the extension arm 13*b* caused by the thread tension. The measuring signal generated by the strain gauge is subsequently used for regulating the rotational speed, such as explained above. The tensile force of the thread 1 which acts upon the deflection pulley 13*a* depends on the angle of the incoming and leaving thread ends relative to the DMS measuring direction. Depending on the constructional design, the angles change according to the bobbin diameter or remain constant. In the following, a few variants will be described with reference to the drawings, wherein the geometrical correlation between the variable bobbin diameter D and the thread force B(D) at a predetermined force S is illustrated analytically. S is the sum of the amounts of the thread forces B(D) which act upon the DMS and is constant in this case.

Figure 9:
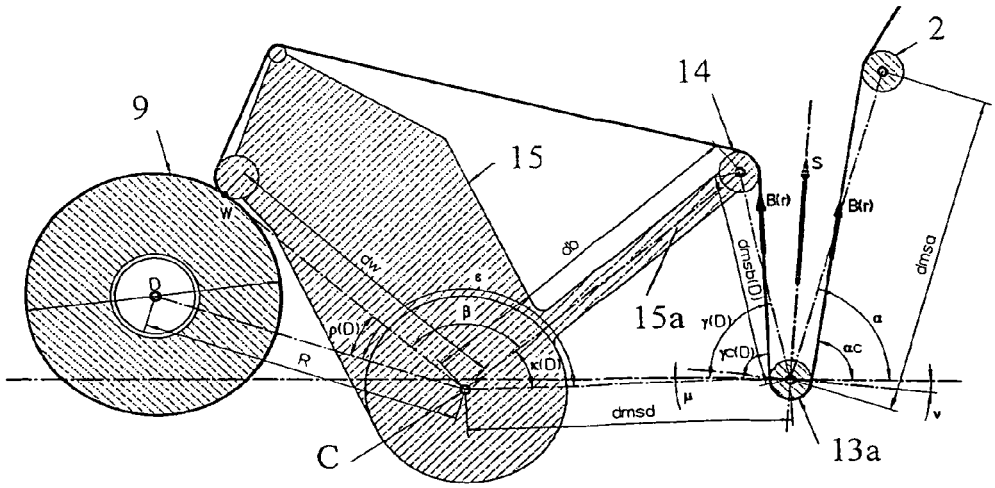
FIG. 9 shows the geometrical correlations of the bobbin winding device in FIG. 4B.
Figure 10:
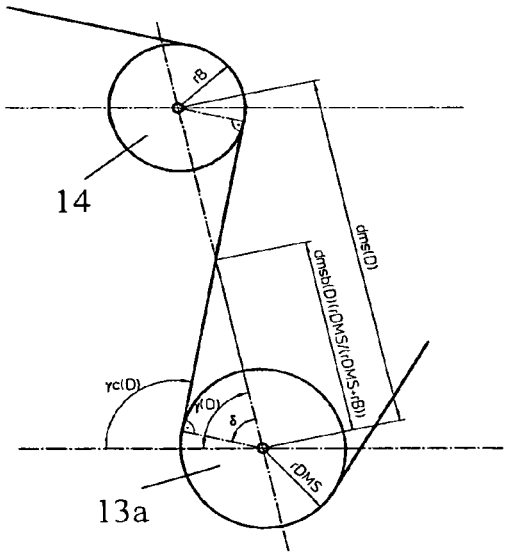
FIG. 10 shows the geometrical correction of angles of the deflection pulleys on the bobbin winding device.

At first, the geometry of the bobbin winding device of FIG. 4B will be illustrated with reference to FIG. 9, which bobbin winding device has a stationary deflection pulley 13*a* of the thread-tension sensor as well as a variable angle between the deflection pulley 13*a* and the thread-support means 14. In the variant, the angle α remains constant. The size of the invariable portion of the incoming thread end depends on angle α and on the measuring direction ν of the thread tension. The amount of the leaving portion is associated with the bobbin diameter. The dependency will be described below in detail. From FIG. 9, it can be seen that the angles α and γ must be corrected because of the radius of the deflection pulleys so as to maintain the force direction of the bandlets. The necessary correction of angles of the deflection pulleys is illustrated in FIG. 10.

The following quantities result via simple angle relations from the constructively provided position parameters:

$$\rho(D) = \arccos\left(\frac{R^2 + dw^2 - \left(\frac{D}{2}\right)^2}{2 \cdot R \cdot dw}\right)$$

$$\kappa(D) = \varepsilon - \beta - \rho(D)$$

$$dmsb(D) = \sqrt{db^2 + dmsd^2 - 2 \cdot db \cdot dmsd \cdot \cos(\kappa(D))}$$

-continued $$\gamma(D) = \arccos\left(\frac{dmsd^2 - dmsb^2(D) - db^2}{2 \cdot dmsd \cdot dmsb(D)}\right) - \mu$$

In consideration of the roll diameter, the angle γ(D) to γc(D) results (see FIG. 10):

$$\gamma c(D) = 90° + \gamma(D) - \arccos\left(\frac{r_{DMS} + r_B}{dmsb(D)}\right)$$

In analogy to γc(D), αc to $$\alpha c = 90° + \alpha - \arccos\left(\frac{r_{DMS} + r_A}{dmsa}\right)$$

results.

If the tilt of the force direction ν of the strain gauge (DMS) is added or subtracted, respectively, to or from the above-indicated angles, the thread force B(D) can be calculated from the predetermined force S.

$$B(D) = S \cdot \frac{1}{\sin(\alpha c + \nu) + \sin(\gamma c(D) - \nu)}$$

Figure 11:
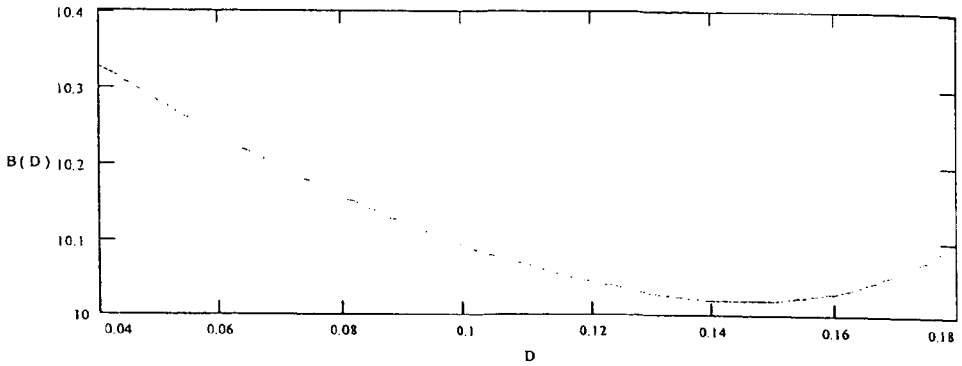
FIG. 11 shows a diagram of the thread strength depending on the bobbin diameter.

In FIG. 11, the course of the thread force B(D) is exemplarily illustrated in Newton [N] depending on the bobbin diameter D in [m]. The angle ν was chosen such that the DMS-force direction was the angular symmetry of the thread force of roll 2 and the angular symmetry of the final positions at D=40 mm and D=180 mm of the thread-support means 14. Hereby, it must be considered that the angular symmetry of the thread to the thread-support means 14 is not reached with an average bobbin diameter D=90 mm but only with a larger diameter D. However, there is a different reason behind the main factor of the asymmetry of the maximum force: The force going to roll 2 being constant, the largest contribution of the thread to the thread-support means 14 is obtained if the thread is positioned in parallel to the DMS-force direction, rather than if the DMS-force direction is positioned in the angular symmetry of both thread forces.

Figure 13:
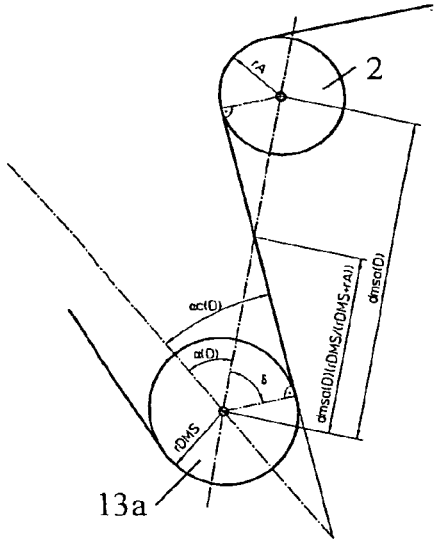
FIG. 13 shows the geometrical correction of angles of the deflection pulleys on the bobbin winding device of FIG. 12.
Figure 12:
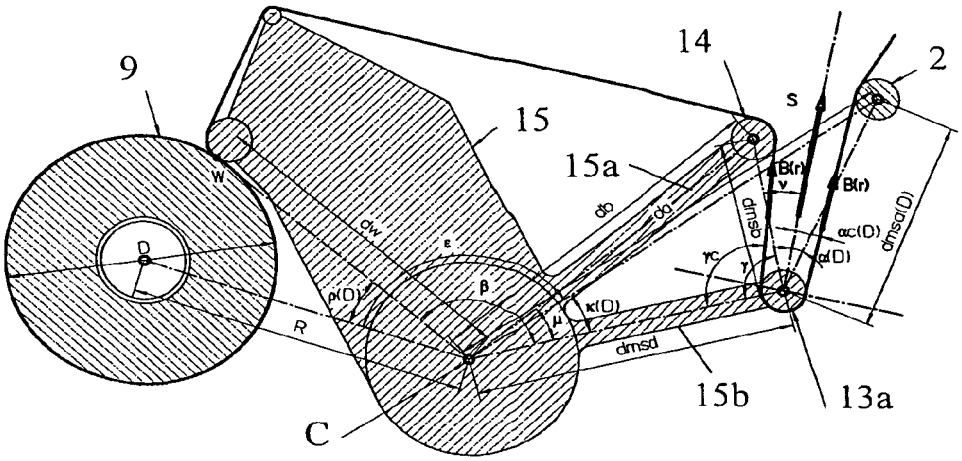
FIG. 12 shows the geometrical correlations of a further embodiment of a bobbin winding device.

In FIG. 12, an embodiment of the bobbin winding device according to the invention is illustrated which has a deflection pulley 13 a of the thread-tension sensor, which pulley pivots together with the control device 15, as well as a variable angle between the deflection pulley 13*a* and the stationary deflection pulley 2. The deflection pulley 13*a* of the thread-tension sensor is connected with the control device 15 via an arm 15*b*. In this way, also the DMS-measuring direction is distorted. In this variant, the angle α thus depends on the bobbin diameter. In this variant, the angle of the thread relative to the thread-support means 14 and to the force direction of the DMS is constant. Instead, the angle of the DMS relative to roll 2 changes. In contrast to the previous variant, this variable angle not only depends on the bobbin diameter D but also on the height of the position of the bobbin winding device. Also in this case, the angles α and γ must be corrected, such as illustrated in FIG. 13.

Hence, the following quantities result via simple angle relations from the constructively provided position parameters:

$$\rho(D) = \arccos\left(\frac{R^2 + dw^2 - \left(\frac{D}{2}\right)^2}{2 \cdot R \cdot dw}\right)$$

$$\kappa(D) = \beta + \rho(D) - \varepsilon$$

$$dmsb = \sqrt{db^2 + dmsd^2 - 2 \cdot db \cdot dmsd \cdot \cos(\mu)}$$

$$dmsa(D) = \sqrt{da^2 + dmsd^2 - 2 \cdot da \cdot dmsd \cdot \cos(\kappa(D))}$$

$$\gamma = \arccos\left(\frac{dmsd^2 - dmsb^2 - db^2}{2 \cdot dmsd \cdot dmsb}\right)$$

$$\alpha(D) = \arccos\left(\frac{dmsa^2(D) + dmsd^2(D) - da^2}{2 \cdot dmsa(D) \cdot dmsd}\right) - \gamma - \nu$$

In consideration of the roll diameters, the angle γ to γc results (see FIG. 10):

$$\gamma c = 90° + \gamma - \arccos\left(\frac{r_{DMS} + r_B}{dmsb}\right)$$

From FIG. 13, αc(D) to:

$$\alpha c(D) = \alpha(D) - 90° + \arccos\left(\frac{r_{DMS} + r_A}{dmsa(D)}\right).$$

results.

If the tilt of the force direction ν of the DMS is added to the above-indicated angle γc, the thread force B(D) can be calculated from the predetermined force S.

$$B(D) = S \cdot \frac{1}{\cos(\alpha c(D)) + \cos(\gamma + \nu - \gamma c)}$$

Figure 14:
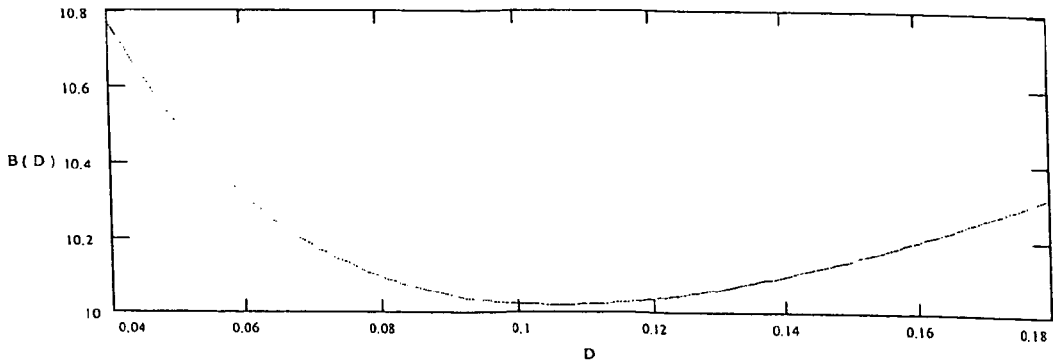
FIG. 14 shows a diagram of the thread strength depending on the bobbin diameter of the embodiment of FIG. 12.

In FIG. 14, the course of the thread force B(D) is exemplarily illustrated in Newton [N] depending on the bobbin diameter D in [m].

Figure 15:
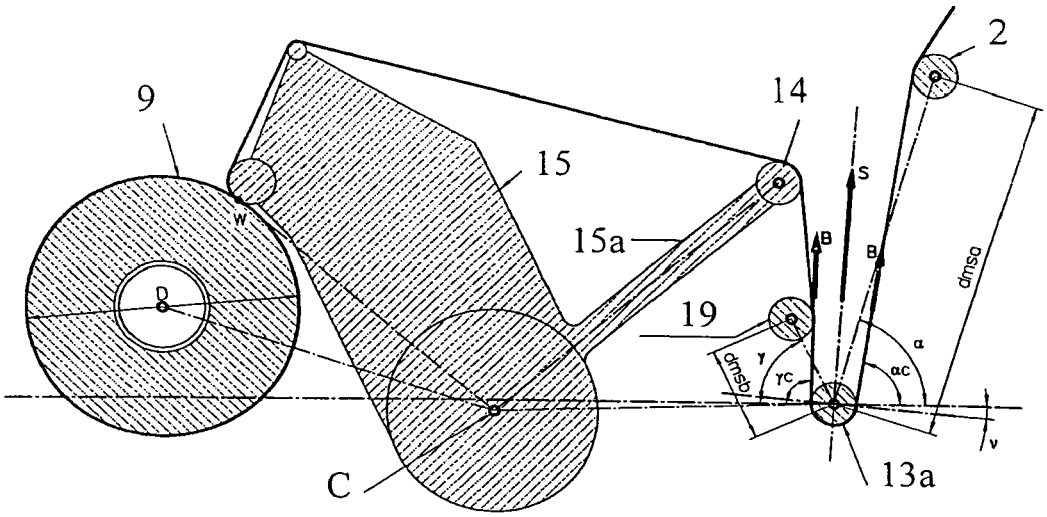
FIG. 15 shows the geometrical correlations of a further embodiment of a bobbin winding device.

In another variant of a bobbin winding device according to the invention as illustrated in FIG. 15, the deflection pulley 13*a* of the thread-tension sensor is arranged in a stationary manner. By means of an additional deflection pulley 19, a resulting constant force direction will be achieved at the deflection pulley 13*a* of the thread-tension sensor. In the variant, the force directions of the thread forces remain constant. Thus, they do not depend on the bobbin diameter D. Both angles γc and αc must again be corrected:

$$\gamma c = 90° + \gamma - \arccos\left(\frac{r_{DMS} + r_B}{dmsb}\right)$$

In analogy to γc, αc to $$\alpha c = 90° + \alpha - \arccos\left(\frac{r_{DMS} + r_A}{dmsa}\right)$$

results.

If the tilt of the force direction ν of the DMS is added or subtracted, respectively, to or from the above-indicated angles, the thread force B can be calculated from the predetermined force S.

$$B = S \cdot \frac{1}{\sin(\alpha c + \nu) + \sin(\gamma c - \nu)}$$

Figure 16:
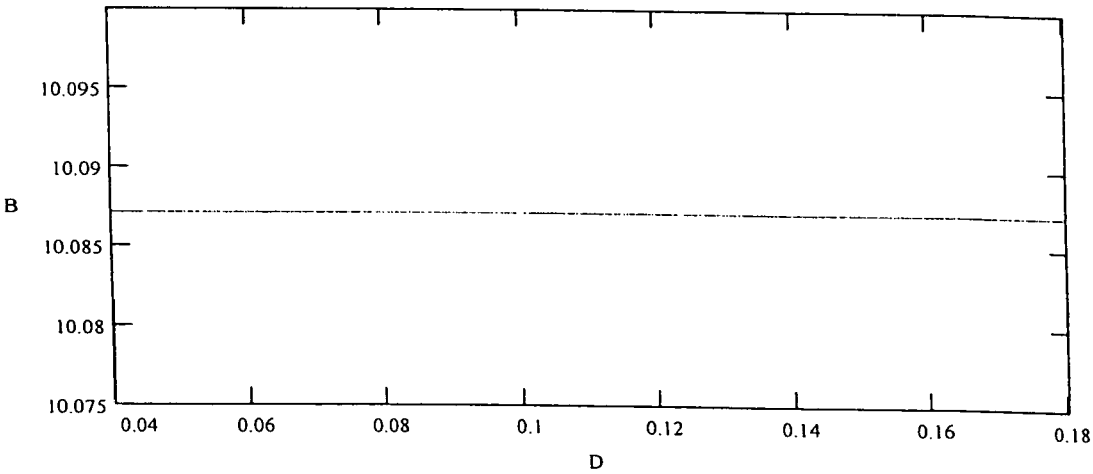
FIG. 16 shows a diagram of the thread strength depending on the bobbin diameter of the embodiment of FIG. 15.

In FIG. 16, the course of the thread force B is exemplarily illustrated in Newton [N]. It is evident that it is completely independent of the bobbin diameter.

The invention claimed is:

1. A bobbin winding device for generating a bobbin by winding a thread or bandlet onto a bobbin core, comprising:

fixing means for holding a bobbin core and rotating it around an axis of rotation (A), thread-pressing means for pressing a thread or bandlet against the peripheral surface of a bobbin that builds up on the bobbin core, whereby the thread-pressing means are movable essentially radially relative to the axis of rotation (A), with the thread-pressing means being configured as a press roll with a longitudinal axis oriented parallel to the axis of rotation (A), a traversing thread guide located close to the thread-pressing means for reciprocating the thread or bandlet along the axis of rotation (A), thread-support means for conducting the thread supplied to the bobbin or bobbin core, respectively, relative to the axis of rotation (A), wherein the thread-pressing means is movable essentially radially relative to the axis of rotation (A) together with the thread-support means so that the distance (z) between the thread-pressing means and the thread-support means will remain constant, with at least one thread deflection means configured as a curved deflection bow being arranged between the thread-pressing means and the thread-support means, which thread deflection means is movable radially relative to the axis of rotation (A) together with the thread-pressing means and the thread-support means, wherein the thread deflection means is configured as a thread-path compensating means and wherein the thread-support means conduct the thread supplied to the bobbin or bobbin core, respectively, in an axially stationary manner relative to the bobbin (A).

2. A bobbin winding device according to claim 1, wherein the thread-pressing means, the thread-support means and the thread deflection means are pivotable about a common swivel axis (C) running in parallel to the axis of rotation (A).

3. A bobbin winding device according to claim 2, wherein the thread-pressing means, the thread-support means and the thread deflection means are integrated in a control device pivotable about the swivel axis (C).

4. A bobbin winding device according to claim 1, wherein the thread-support means are configured as a roll or lug.

5. A bobbin winding device according to claim 1, wherein a thread-tension sensor is arranged upstream of the thread-support means.

6. A bobbin winding device according to claim 5, wherein the thread-tension sensor is arranged in a stationary manner.

7. A bobbin winding device according to claim 6, wherein a stationary thread deflection means is arranged between the thread-support means and the thread-tension sensor.

8. A bobbin winding device according to claim 5, wherein the thread-tension sensor is movable together with the thread-support means so that the distance therebetween will remain constant.

9. A bobbin winding device according to claim 5, wherein the thread-tension sensor comprises an arm with a strain gauge, with the arm carrying a thread deflection means.

10. A bobbin winding device according to claim 9, wherein the thread deflection means produces a deflection of the thread or bandlet by 150 to 180°.

11. A bobbin winding device according to claim 5, wherein output signals (TS) of the thread-tension sensor, which are representative for the thread tension, can be supplied to a control unit as input signals, with the control unit regulating the rotational speed of a bobbin drive motor depending on the input signals and a reference signal (Ref).

12. A bobbin winding device according to claim 11, wherein the drive motor rotates the fixing device of the bobbin core.

13. A bobbin winding device according to claim 12, wherein the control unit is configured as a PID controller.

14. A bobbin winding device for generating a bobbin by winding a thread or bandlet onto a bobbin core, comprising:

fixing means for holding a bobbin core and rotating it around an axis of rotation (A), thread-pressing means for pressing a thread or bandlet against the peripheral surface of a bobbin that builds up on the bobbin core, whereby the thread-pressing means are movable essentially radially relative to the axis of rotation (A), with the thread-pressing means being configured as a press roll with a longitudinal axis oriented parallel to the axis of rotation (A), a traversing thread guide located close to the thread-pressing means for reciprocating the thread or bandlet along the axis of rotation (A), thread-support means for conducting the thread supplied to the bobbin or bobbin core, respectively, relative to the axis of rotation (A), wherein the thread-pressing means is movable essentially radially relative to the axis of rotation (A) together with the thread-support means so that the distance (z) between the thread-pressing means and the thread-support means will remain constant, with at least one thread deflection means being arranged between the thread-pressing means and the thread-support means, which thread deflection means is movable radially relative to the axis of rotation (A) together with the thread-pressing means and the thread-support means, wherein the thread deflection means is configured as a thread-path compensating means comprising a deflection bow which is curved at a predetermined radius and wherein the thread-support means conduct the thread supplied to the bobbin or bobbin core, respectively, in an axially stationary manner relative to the bobbin (A).

15. A bobbin winding device according to claim 14, wherein the thread-pressing means, the thread-support means and the thread deflection means are pivotable about a common swivel axis (C) running in parallel to the axis of rotation (A).

16. A bobbin winding device according to claim 15, wherein the thread-pressing means, the thread-support means and the thread deflection means are integrated in a control device pivotable about the swivel axis (C).

17. A bobbin winding device according to claim 14, wherein the thread-support means are configured as a roll or lug.

18. A bobbin winding device according to claim 14, wherein a thread-tension sensor is arranged upstream of the thread-support means.

* * * * *